United States Patent [19]

DeLuca et al.

[11] Patent Number: 4,753,606

[45] Date of Patent: Jun. 28, 1988

[54] TELEPHONE CONNECTOR BLOCK WITH TEMPORARY CONDUCTOR RETENTION MEANS

[75] Inventors: Paul V. DeLuca, Plandome Manor; Michael Fasano, Syosset, both of N.Y.

[73] Assignee: Porta Systems Corp., Syosset, N.Y.

[21] Appl. No.: 109,322

[22] Filed: Oct. 19, 1987

[51] Int. Cl.[4] ..... H01R 13/64

[52] U.S. Cl. ..... 439/374; 439/447; 439/457; 439/719

[58] Field of Search ..... 439/246, 247, 248, 374, 439/376, 407, 409, 410, 417, 445, 446, 447, 449, 452, 455, 456, 457, 458, 459, 460, 468, 473, 474, 488, 491, 709, 711, 712, 713, 719, 725

[56] References Cited

U.S. PATENT DOCUMENTS

| | | | |
|---|---|---|---|
| 2,810,056 | 10/1957 | Aldous | 439/457 |
| 2,999,962 | 9/1961 | Wahl | 439/452 |
| 4,059,331 | 11/1977 | Sedlacek et al. | 439/719 |
| 4,095,870 | 6/1978 | Mathe | 439/459 |
| 4,512,622 | 4/1985 | Carney et al. | 439/449 |

FOREIGN PATENT DOCUMENTS

| | | | |
|---|---|---|---|
| 1590504 | 5/1970 | Fed. Rep. of Germany | 439/468 |
| 2523915 | 12/1976 | Fed. Rep. of Germany | 439/468 |

*Primary Examiner*—David Pirlot

*Attorney, Agent, or Firm*—Charles E. Temko

[57] ABSTRACT

A telephone connector block having improved means for temporarily retaining the ends of individual subscriber pairs adjacent the open ends of quick-clip connectors prior to engagement therewith using an installation tool. This is accomplished by a strain relief means which engages an individual conductor as the same is bent to substantially a right angle relative to the axis of the opening in the adjacent quick clip terminal whereby upon bending the end of the conductor and the engagement of a short projection on the strain relief means, the conductor remains in desired position prior to full engagement with the quick-clip terminal.

3 Claims, 2 Drawing Sheets

TELEPHONE CONNECTOR BLOCK WITH TEMPORARY CONDUCTOR RETENTION MEANS

BACKGROUND OF THE INVENTION

This invention relates generally to the field of connector blocks used in the telephone industry, and more particularly to an improved block of quick-clip terminal type having means for temporarily retaining the ends of unattached conductors in predetermined location ready for final seating using a known wire installation tool adapted for the purpose.

In the traditional telephone connector block, it is common to attach the ends of telephone subscriber circuits by engaging the bare ends of the conductors by wrapping them about corresponding pins using a wire wrap tool. More recently developed blocks have replaced at least some of the wire wrap pins with so-called insulation displacement quick-clip terminals in which the end of a conductor is forced between opposing terminal members defining a slot using a special tool for this purpose. The tool also cuts the conductor during the seating operation to proper length.

When handling a large number of such conductors on a single block, typically, one hundred subscriber pairs, it is convenient to first position all of the ends of the conductors at the open ends of the corresponding quick clip terminals, and thereafter, to seat the conductors in serial fashion. This procedure has been facilitated by the provision of means for holding the ends of the conductors so that they do not slip from position, as described in pending application Ser. No. 896,119 of 8/13/86 said application being assigned to the same assignee as the present application. However, the means disclosed in this application is not applicable to telephone blocks of all configurations, principally because of the direction of appearance of the conductors relative to the axis of the quick-clip connectors to be engaged.

U.S. Pat. No. 4,512,622 granted to William Carney, et al., and assigned to the same assignee as the present application, discloses a telephone connector block in which the incoming subscriber lines, once separated from the incoming cable, are secured upon wire wrap pins. When these pins are replaced by quick-clip terminals to facilitate faster installation time, there arises the need for a temporary retention means for holding the subscriber conductors until they can be seated. In order to use a known installation tool for this purpose, the quick-clip terminals must be positioned in a particular mutually spaced arrangement which does not permit utilization of the retention means disclosed in the above-mentioned patent application.

SUMMARY OF THE INVENTION

Briefly stated, the invention contemplates the provision of an improved temporary positioning and retaining means for individual subscriber pair conductors suitable for use where the conductors initially enter the block in a plane perpendicular to the quick-clip terminals to which they are attached. The quick clip terminals each accommodate a single conductor comprising a subscriber pair, and are arranged in parallel vertical rows, each terminal in a given row communicating on either side thereof with a wire guiding channel. Between each adjacent pair of terminals in a given row are insulative members defining a wire accommodating slot, the insulative member having an upwardly extending projection about which a conductor may be looped in such manner that the projection prevents unintended removal of the conductor prior to seated installation. The positioning of the ends of the conductors prior to engagement within the slots of the terminals requires only the manual forming of a loop in the conductor by a craftsman while simultaneously engaging the projection which retains it.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
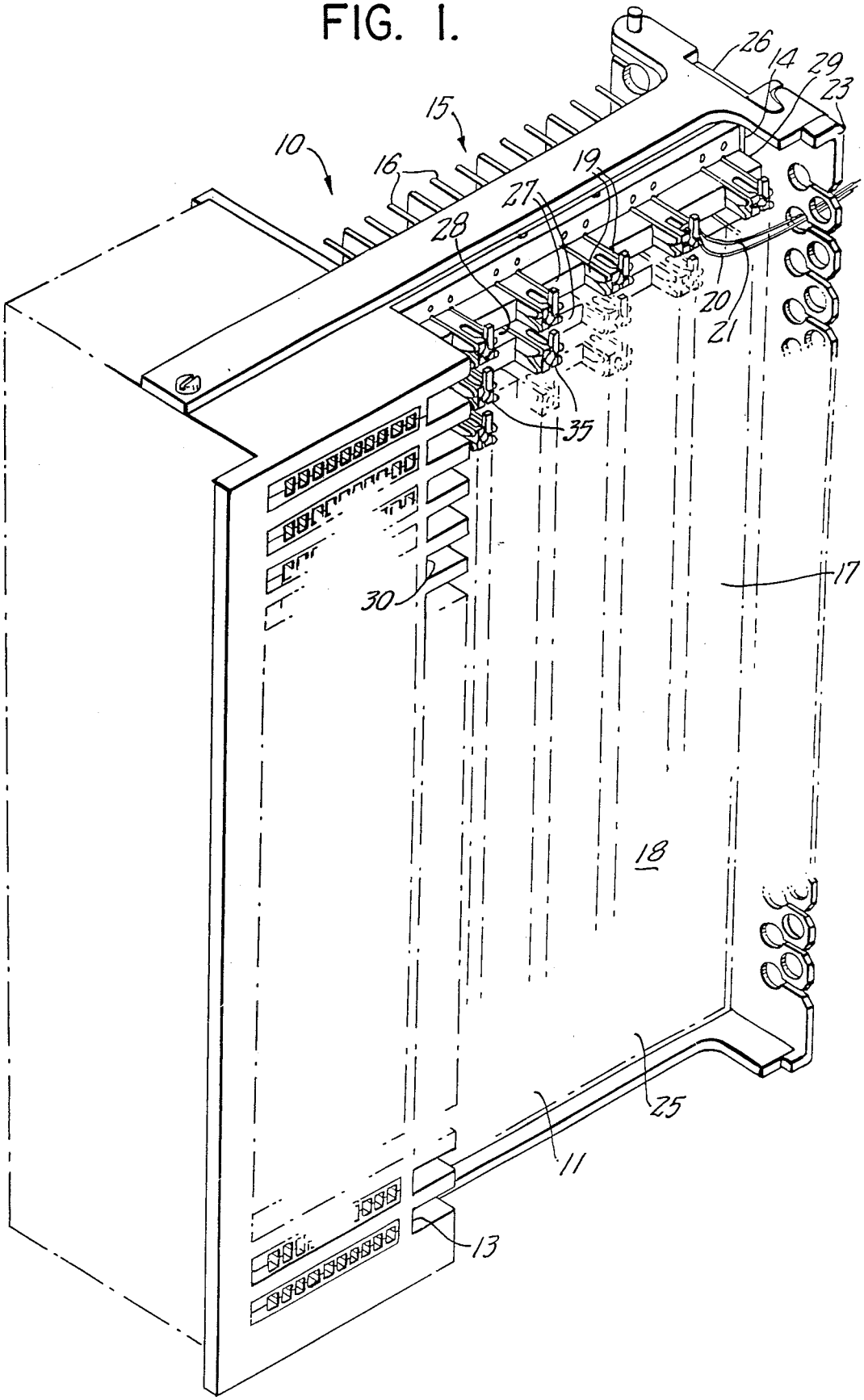
FIG. 1 is a front and side perspective view of a telephone connector block embodying the disclosed invention.
Figure 2:
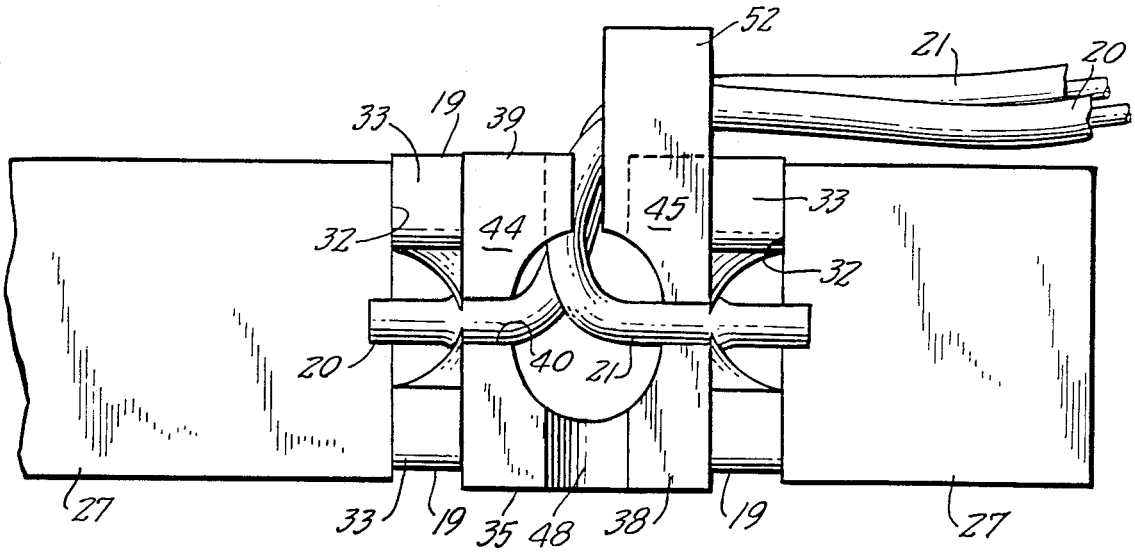
FIG. 2 is an enlarged fragmentary side elevational view corresponding to the upper right-hand portion of FIG. 1.
Figure 3:
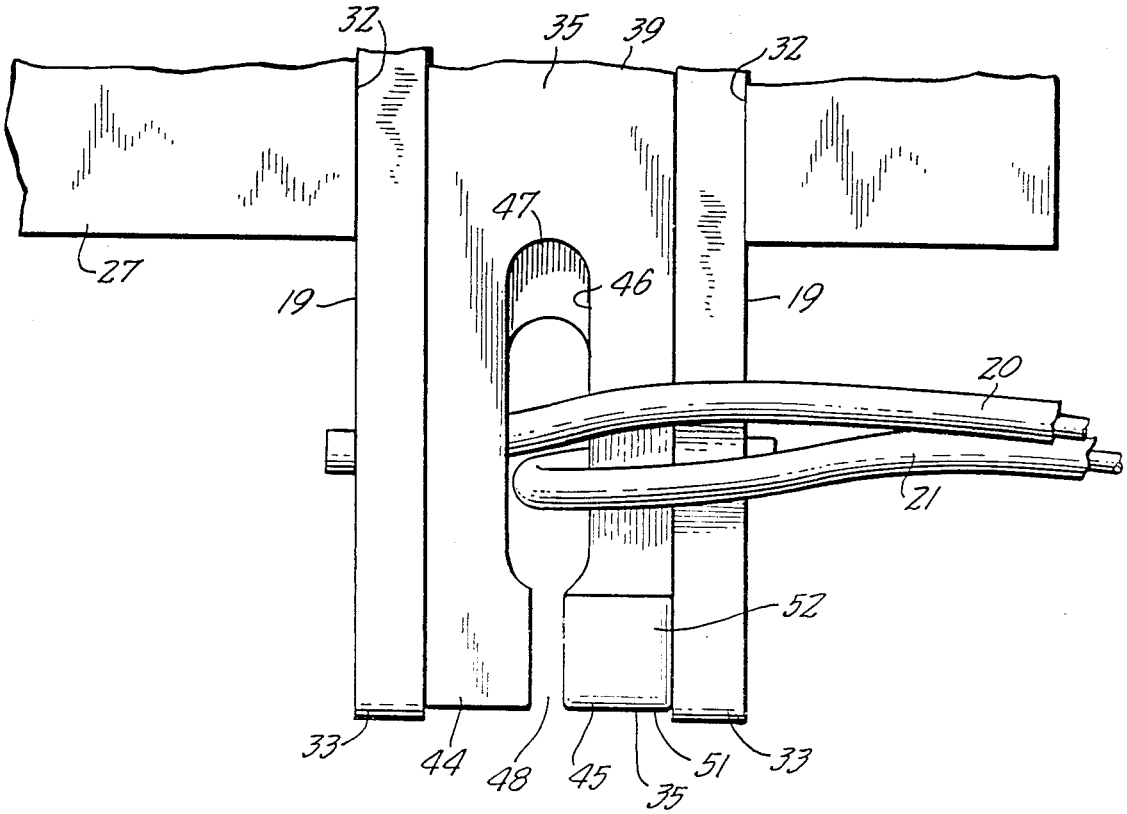
FIG. 3 is a top plan view thereof as seen from the upper portion of FIG. 2.

In accordance with the invention, the device, generally indicated by reference character 10, is in the form of a telephone connector block capable of being mounted upon a telephone main frame (not shown) located in a telephone central office. The block 10 includes a longitudinal wall 11 supporting a forward section 12 at a forward edge 13 thereof. A rearward edge 14 engages bracket means (not shown) in well-known manner to provide means to engage the frame. A first side 15 supports telephone protector modules (not shown) of known type on pins 16. A second side 17 supports a mounting plate 18 which, in turn, supports quick clip terminals 19 which communicate with the pins 16.

The terminals 19 are grouped in pairs, wherein each may engage one of a pair of subscriber pair conductors 20–21 which emanate from the frame. The wall 11 includes a base 25 having an exposed surface 26 from which extend a plurality of laterally-oriented flanges 27 which form wire guide channels therebetween. The channels extend from a rearward end 29 to a forward end 30 and substantially overlie the terminals 19.

Located in the flanges 27 are parallel slotted openings 32, each of which positions a conventional single conductor quick clip terminal 33 which are grouped in pairs, as mentioned hereinabove. Positioned between the terminals 33 is an insulative conductor retaining element 35 which may be formed integrally with the base wall 25. Each element 35 includes a lower portion 38 and an upper portion 39 forming therebetween, a horizontally oriented interstice 40. The lower portion 38 defines a short slot permitting the entry of an installation tool. The upper portion 39 forms first and second legs 44 and 45 defining an elongated slot 46 therebetween which extends from an inner end 47 to an outer constricted end 48 which is resiliently expandable. At the outer end of the second leg 45 indicated by reference character 51, is a vertically oriented projection 52.

During installation, the craftsperson will lead conductor pairs from the frame through the proper channel 28 to the group of terminals intended for interconnection. A first of the conductors 20 intended to be engaged with the leftward one of the pair of terminals can be positioned first within the slot 46, to be followed by the second conductor which has been bent through substantially 180° to form a small loop which is retained by contact with the projection 52. The retention of the second conductor, in turn, provides retention for the first conductor, so that both conductors can be positioned opposite the opened ends of the respective quick-clip terminals for subsequent interconnection.

Since the conductors tend to retain an imparted shape, it will be readily appreciated that they cannot accidentially be dislodged from their positions within the slot 46, which serves as a temporary anchor point assuring that the actual ends of the conductors will remain adjacent the open ends of the terminals, without the use of any tool.

With all of the wiring on a given block positioned as described above, the craftsperson may then resort to the wire installation tool and serially seat each of the pairs to operative condition, the tool automatically severing the conductors to proper length, as is well-known in the art.

It may thus be seen that there has been provided, an improved wire retention means which may be incorporated into connector blocks having quick clip terminals, the plane of which lies at right angles to the axis of entry of conductors intended to be seated thereupon. Using the normal rigidity of the conductors themselves, they can be bent to a predetermined position which enables them to engage a small projection associated with each pair of quick clip terminals in such manner as to prevent unintentional disengagement.

We wish it to be understood that we do not consider the invention to be limited to the precise details of structure shown and set forth in this specification, for obvious modifications will occur to those skilled in the art to which the invention pertains.

We claim:

1. A telephone connector block for interconnecting subscriber pairs having a plurality of quick-clip terminals including improved means for temporarily locating the ends of said conductors in position for engagement with said terminals using a tool for forcing said ends into expandable slots in said terminals, said block comprising: a planar wall supporting said quick-clip terminals in parallel rows to extend laterally therefrom in individual groups of two terminals aligned in parallel relation and defining an interstice therebetween; a plurality of insulative conductor retaining elements carried by said planar wall, each positioned within an interstice between said two terminals; said conductor retaining elements each including a first portion positioned between a first leg of each of said terminals, and a second portion positioned between a second leg of each of said terminals, said first and second portions defining an interstice; said first portion including a pair of parallel legs lying in a plane, and defining a conductor retaining slot, said slot having a constricted resiliently expandable free end, one of said legs having a projection extending at an angle relative to said plane at a free end thereof; whereby subscriber pair conductors may be lead along said planar wall to the area of an individual group, and bent through substantially a right angle to enter said conductor retaining slot in said conductor retaining element to be at least partially retained in predetermined location by contact with a surface of said projection.

2. A telephone connector block in accordance with claim 1, further characterized in the provision of laterally extending flanges forming wire guide channels on each side of coplanar groups of terminals.

3. A telephone connector block in accordance with claim 1, further characterized in said projections being positioned on that side of said slot from which conductors emanate.

* * * * *